US011488555B2

(12) United States Patent
Wu

(10) Patent No.: US 11,488,555 B2
(45) Date of Patent: Nov. 1, 2022

(54) DISPLAY PANEL, DRIVING METHOD THEREOF AND DISPLAY APPARATUS

(71) Applicant: HKC CORPORATION LIMITED, Shenzhen (CN)

(72) Inventor: Chuan Wu, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 58 days.

(21) Appl. No.: 17/042,178

(22) PCT Filed: Dec. 13, 2018

(86) PCT No.: PCT/CN2018/120834

§ 371 (c)(1),
(2) Date: Sep. 27, 2020

(87) PCT Pub. No.: WO2020/113647

PCT Pub. Date: Jun. 11, 2020

(65) Prior Publication Data

US 2021/0118382 A1 Apr. 22, 2021

(30) Foreign Application Priority Data

Dec. 5, 2018 (CN) ..... 201811480085.2

(51) Int. Cl.
*G09G 3/36* (2006.01)

(52) U.S. Cl.
CPC ..... *G09G 3/3614* (2013.01); *G09G 3/3607* (2013.01); *G09G 3/3677* (2013.01);
(Continued)

(58) Field of Classification Search
CPC .. G09G 3/3614; G09G 3/3607; G09G 3/3677; G09G 3/3688; G09G 3/3648;
(Continued)

(56) References Cited

U.S. PATENT DOCUMENTS 6,075,505 A 6/2000 Shiba et al.
2007/0216632 A1* 9/2007 Lee ..... G09G 3/3677 345/100

(Continued)

FOREIGN PATENT DOCUMENTS

CN 101520998 A 9/2009
CN 102354486 A 2/2012

(Continued)

OTHER PUBLICATIONS

Yanyan Wei, the ISA written comments, dated Aug. 2018, CN.
Yanyan Wei, the International Search Report, dated Aug. 2018, CN.

*Primary Examiner* — David Tung

(57) ABSTRACT

This application discloses a display panel, a driving method thereof and a display apparatus. The display panel includes a substrate, the substrate being provided with a plurality of data lines, a plurality of gate lines, and a plurality of pixel units; and a gate driver chip, where each pixel unit includes subpixels of different colors; the gate driver chip outputs gate enabling signals to the gate lines to turn on the pixel units; and each row of pixel units includes a plurality of pixel groups, each pixel group includes a first column of subpixels and a second column of subpixels and a voltage of a gate enabling signal of the first column of subpixels is greater than that of a gate enabling signal corresponding to the second column of subpixels.

16 Claims, 6 Drawing Sheets

(52) U.S. Cl.
CPC ..... *G09G 3/3688* (2013.01); *G09G 2310/06* (2013.01); *G09G 2320/0233* (2013.01)

(58) Field of Classification Search
CPC ..... G09G 2310/06; G09G 2310/066; G09G 2320/0233; G09G 2320/0219; G09G 2320/0223
See application file for complete search history.

(56) References Cited

U.S. PATENT DOCUMENTS

| | | | | |
|---|---|---|---|---|
| 2008/0079678 | A1* | 4/2008 | Cho | G09G 3/3648 345/88 |
| 2008/0225035 | A1* | 9/2008 | Hsu | G09G 3/3696 345/212 |
| 2009/0189883 | A1* | 7/2009 | Chung | G09G 5/00 345/213 |
| 2013/0050171 | A1 | 2/2013 | Tsai | |
| 2015/0310815 | A1* | 10/2015 | Deng | G09G 3/3614 345/209 |
| 2016/0365045 | A1* | 12/2016 | Chen | G09G 3/3677 |
| 2018/0025684 | A1* | 1/2018 | Chan | G09G 3/2092 345/213 |

FOREIGN PATENT DOCUMENTS

| | | | |
|---|---|---|---|
| CN | 102568398 | A | 7/2012 |
| CN | 104317086 | A | 1/2015 |
| CN | 104391411 | A | 3/2015 |
| CN | 107767832 | A | 3/2018 |
| CN | 108847194 | A | 11/2018 |

* cited by examiner

DISPLAY PANEL, DRIVING METHOD THEREOF AND DISPLAY APPARATUS

CROSS REFERENCE OF RELATED APPLICATIONS

This application claims the priority to the Chinese Patent Application No. CN201811480085.2, filed with National Intellectual Property Administration, PRC on Dec. 5, 2018 and entitled "DISPLAY PANEL, DRIVING METHOD THEREOF AND DISPLAY APPARATUS", which is incorporated herein by reference in its entirety.

TECHNICAL FIELD

This application relates to the technical field of display, in particular to a display panel, a driving method thereof and a display apparatus.

BACKGROUND

Statement herein merely provides background information related to this application and does not necessarily constitute the existing technology.

With development and advancement of science and technologies, due to hot spots such as thinness, power saving, and low radiation, liquid crystal displays become mainstream products of displays and are widely applied. Most of LCDs in the current market are backlight-type LCDs. A backlight-type LCD includes an LCD panel and a backlight module. The working principle of the liquid crystal panel is: Liquid crystal molecules are placed between two parallel glass substrates, and a drive voltage is applied across the two glass substrates to control rotating directions of the liquid crystal molecules, so that light in the backlight module is refracted out to generate an image.

Half-source driver (HSD) is a low-cost production scheme commonly used in the field of display panels. The scheme doubles the number of scanning lines so that a single data line can correspond to subpixels of two adjacent columns, thereby saving source driver integrated chips by half, but there will be bright and dark lines in a vertical direction.

SUMMARY

This application provides a display panel, a driving method thereof and a display apparatus to realize brightness equalization.

To achieve the above object, this application provides a display panel, including a substrate, and the substrate is provided with a plurality of data lines, a plurality of gate lines, and a plurality of pixel units; and a gate driver chip, wherein each pixel unit includes subpixels of different colors; the gate driver chip outputs gate enabling signals to the gate lines to turn on the pixel units; each row of pixel units includes a plurality of pixel groups, each pixel group includes a first column of subpixels in the front and an adjacent following second column of subpixels, the first column of subpixels and the second column of subpixels are connected with the same data line, and the first column of subpixels and the second column of subpixels are connected to two different gate lines; the polarities of data driving signals adopted by two adjacent pixel groups in each row of pixel units are opposite; and a voltage of a gate enabling signal of the first column of subpixels is greater than that of a gate enabling signal corresponding to the second column of subpixels.

Optionally, the charging voltages of the first column of subpixels and the second column of subpixels are the same.

Optionally, the polarities of data driving voltages corresponding to the first column of subpixels and the second column of subpixels are the same, the first column of subpixels are odd-column subpixels, the second column of subpixels are even-column subpixels, and the voltage of a first gate enabling signal corresponding to the odd-column subpixels is greater than that of a second gate enabling signal of the even-column subpixels.

Optionally, a difference between the voltage of the first gate enabling signal corresponding to the odd-column subpixels and the voltage of the second gate enabling signal corresponding to the even-column subpixels is y, and y is greater than 0 and less than or equal to 10 v.

Optionally, a waveform of the voltage of the first gate enabling signal and a waveform of the voltage of the second gate enabling signal are both chamfered waveforms.

Optionally, a slope of a chamfer of the first gate enabling signal is greater than that of a chamfer of the second gate enabling signal.

Optionally, the first gate enabling signal includes a first pre-chamfer interval and a first chamfer interval in each cycle; the second gate enabling signal includes a second pre-chamfer interval and a second chamfer interval in each cycle; a voltage of the first pre-chamfer interval is greater than that of the second pre-chamfer interval; and a lowest voltage of the first chamfer interval is equal to a voltage of the second chamfer interval.

Optionally, the first chamfer interval and the second chamfer interval start at the same time.

Optionally, a slope of the first chamfer interval is greater than that of the second chamfer interval.

Optionally, the voltage of the first gate enabling signal of the odd-column subpixels after chamfering is equal to the voltage of the second gate enabling signal of the even-column subpixels after chamfering.

Optionally, the display panel adopts a half-source driver.

Optionally, the display panel adopts a dual driving mode.

This application also discloses a driving method applying the display panel as described above, including the following steps:

outputting, by a gate driver chip, gate enabling signals to each row of pixel units according to control signals;

outputting, by a data driver chip, the same data signal to a first column of subpixels and a second column of subpixels of each row of pixels;

controlling two adjacent pixel groups in each row of pixel units to adopt data driving signals with opposite polarities; and controlling, by the gate driver chip, a voltage of a gate enabling signal corresponding to the first column of subpixels to be greater than that of a gate enabling signal corresponding to the second column of subpixels.

Optionally, the polarities of data driving voltages corresponding to the first column of subpixels and the second column of subpixels are the same, the first column of subpixels are odd-column subpixels, the second column of subpixels are even-column subpixels, and the voltage of the first gate enabling signal corresponding to the odd-column subpixels is greater than that of the second gate enabling signal of the even-column subpixels.

Optionally, the charging voltages of the first column of subpixels and the second column of subpixels are the same.

Optionally, a difference between the voltage of the first gate enabling signal corresponding to the odd-column subpixels and the voltage of the second gate enabling signal corresponding to the even-column subpixels is y, and y is greater than 0 and less than or equal to 10 v.

Optionally, a waveform of the voltage of the first gate enabling signal and a waveform of the voltage of the second gate enabling signal are both chamfered waveforms; the first gate enabling signal includes a first pre-chamfer interval and a first chamfer interval in each cycle; the second gate enabling signal includes a second pre-chamfer interval and a second chamfer interval in each cycle; a voltage of the first pre-chamfer interval is greater than that of the second pre-chamfer interval; and a lowest voltage of the first chamfer interval is equal to a voltage of the second chamfer interval.

Optionally, a slope of the first chamfer interval is greater than that of the second chamfer interval.

This application further discloses a display apparatus, including the foregoing display panel.

Optionally, the display apparatus is one of a twisted nematic display apparatus, an in-plane switching display apparatus, and a multi-domain vertical alignment display apparatus.

In a half-source driver, when a gate voltage across adjacent even-column subpixels is equal to a gate signal of the odd-column subpixels, due to the difference in actual charging time between the adjacent even-column subpixels and the odd-column supixels caused by the positive and negative polarity inversion of the data lines, the charging voltages of the pixels are different, so there are bright and dark lines in a vertical direction. In this scheme, by enabling the voltage of the gate enabling signal corresponding to the first column of subpixels to be greater than that of the gate enabling signal corresponding to the second column of subpixels, a corresponding gate can be turned on faster due to the enhancement of the voltage of the gate enabling signal corresponding to the first column of subpixels, so that the first column of subpixels can reach a higher charging voltage faster, the difference in charging voltage corresponding to two pixels before and after polarity inversion is reduced or even eliminated, and the charging voltages of two adjacent pixels tend to be the same, thus solving the problem of visual bright and dark lines in the vertical direction; in addition, the scheme does not require a design change, only needs to output gate enabling signals with different voltages every other row, and is convenient to operate.

BRIEF DESCRIPTION OF DRAWINGS

The drawings included are used for providing understanding of embodiments of the present application, constitute part of the specification, and are used for illustrating implementation manners of the present application, and interpreting principles of the present application together with text description. Apparently, the accompanying drawings in the following descriptions are merely some embodiments of this application, and a person of ordinary skill in the art can also obtain other accompanying drawings according to these accompanying drawings without involving any creative effort. In the accompanying drawings.

DETAILED DESCRIPTION OF EMBODIMENTS

Figure 1:
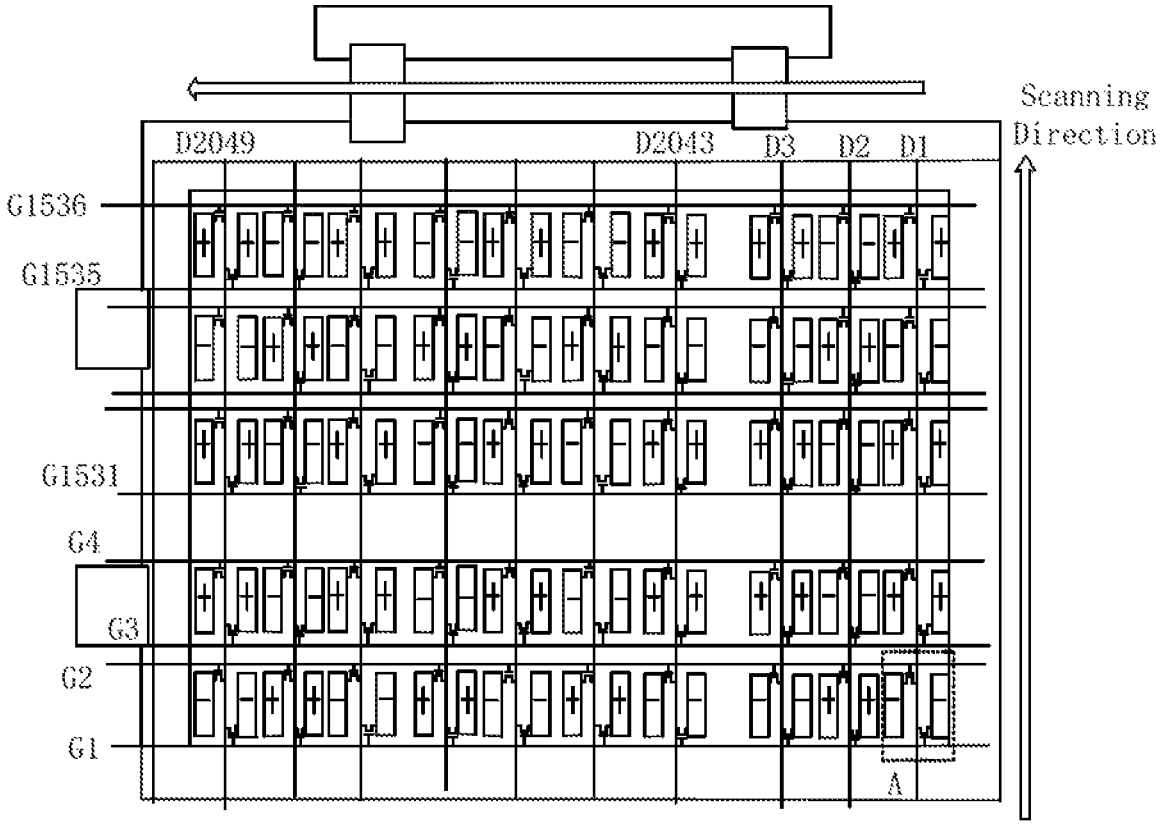
FIG. 1 is a schematic diagram of a half-source driver according to an embodiment of this application.

Specific structures and functional details disclosed herein are merely representative, and are intended to describe the objectives of the exemplary embodiments of this application. However, this application may be specifically implemented in many alternative forms, and should not be construed as being limited to the embodiments set forth herein.

In the description of this application, it should be understood that orientation or position relationships indicated by the terms such as "center", "transverse", "on", "below", "left", "right", "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application. In addition, the terms such as "first" and "second" are used only for the purpose of description, and should not be understood as indicating or implying the relative importance or implicitly specifying the number of the indicated technical features. Therefore, a feature defined by "first" or "second" can explicitly or implicitly includes one or more of said features. In the description of this application, unless otherwise stated, "a plurality of" means two or more than two. In addition, the terms "include", "comprise" and any variant thereof are intended to cover non-exclusive inclusion.

In the description of this application, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. Persons of ordinary skill in the art may understand the specific meanings of the foregoing terms in this application according to specific situations.

The terminology used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and/or "comprise" when used in this specification, specify the presence of stated features, integers, steps, and/or operations, but do not preclude the presence or addition of one or more other features, integers, steps, operations, and/or combinations thereof.

This application is described below with reference to the accompanying drawings and embodiments.

Figure 2:
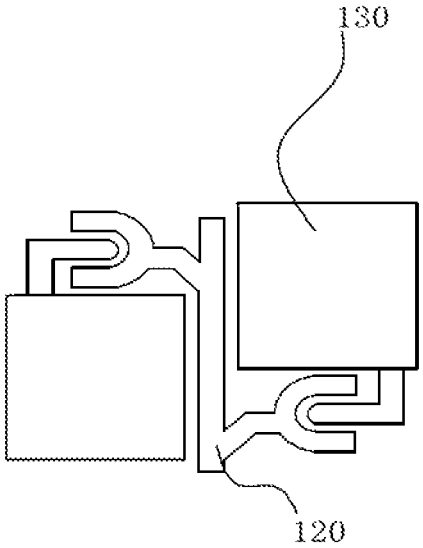
FIG. 2 is a partially enlarged schematic view of area A in FIG. 1.
Figure 3:
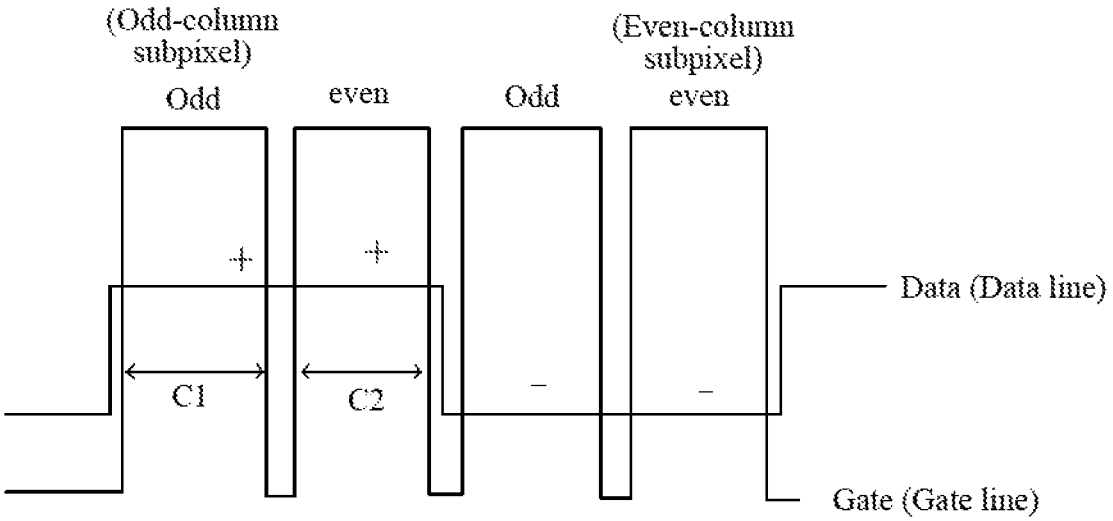
FIG. 3 is a schematic diagram of a data output waveform of the half-source driver according to an embodiment of this application.
Figure 4:
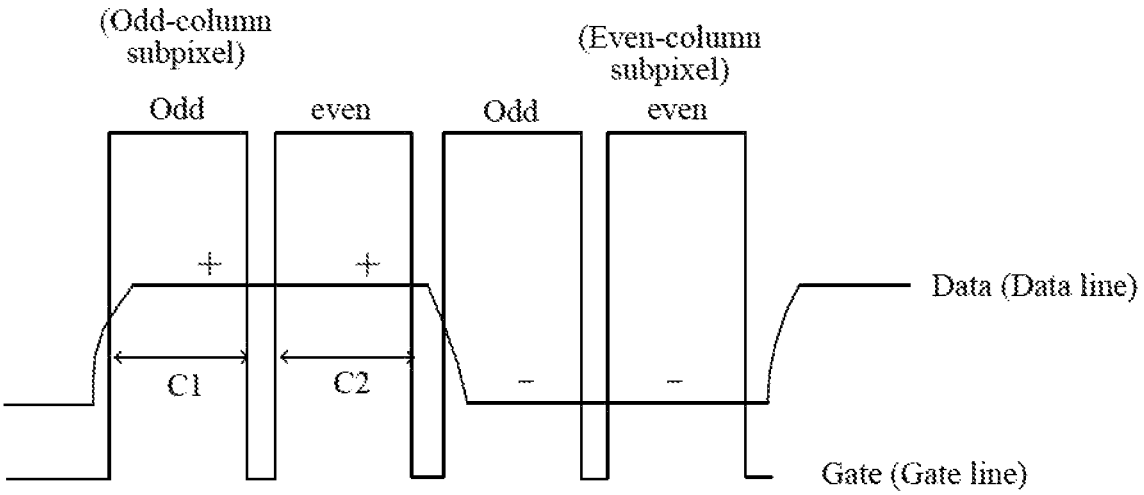
FIG. 4 is a schematic diagram of an actual data output waveform of the half-source driver according to an embodiment of this application.
Figure 5:
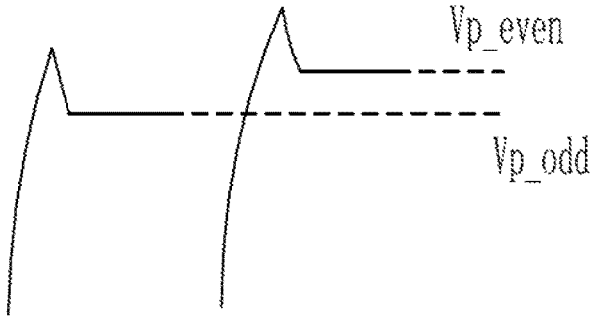
FIG. 5 is a schematic diagram of a pixel voltage of the half-source driver according to an embodiment of this application.
Figure 6:
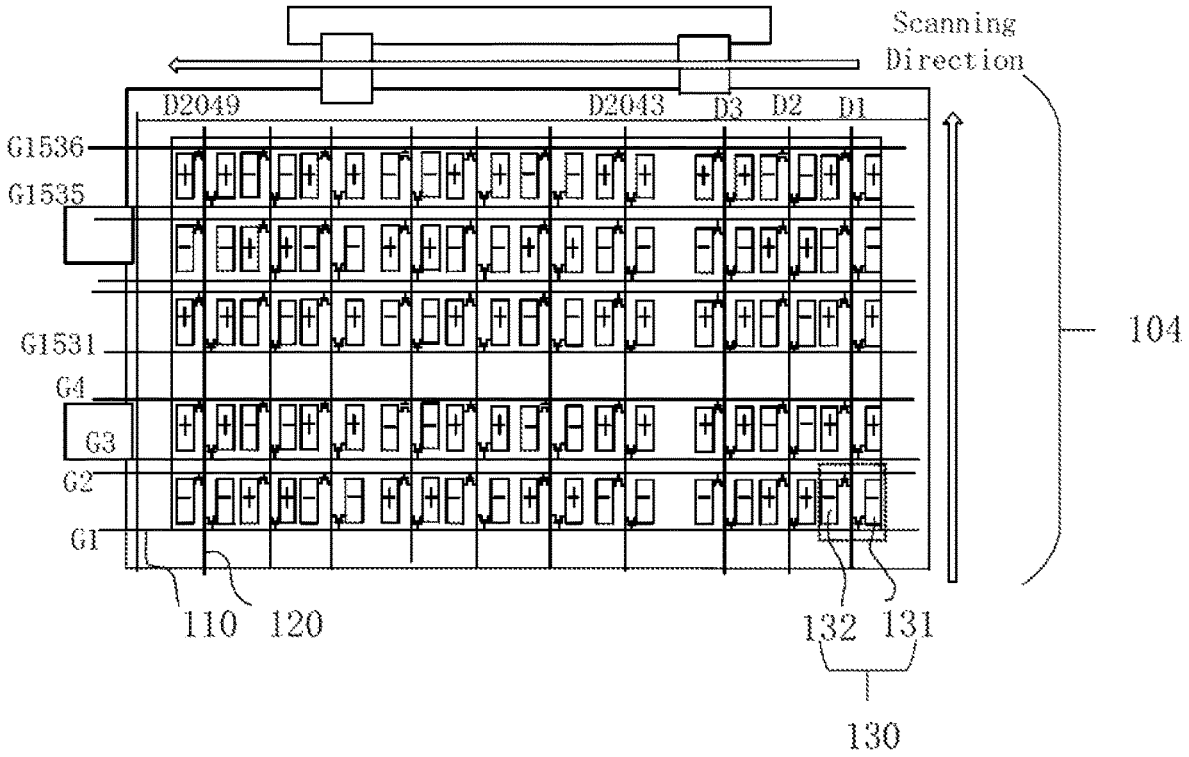
FIG. 6 is a schematic diagram of a display panel according to an embodiment of this application.

Referring to FIG. 1 and FIG. 2, two adjacent columns of subpixels share a data line, and adjacent pixel units are connected with different gate lines. When a gate enabling signal is turned on, thin film transistors of a corresponding row are turned on. At this point, a data line in a vertical direction introduces a corresponding data signal to charge a storage capacitor to an appropriate voltage, so as to display one row of images. Referring to FIG. 3 and FIG. 4, where Data represents a waveform of a data line. Gate represents a waveform of a gate line, and when Gate is at its peak, a turned-on state is realized, that is, corresponding odd-column subpixels Odd and even-column subpixels even are turned on. Positive and negative polarity inversion exists in a data line. When the positive and negative polarities of the data line are inverted, a data driving voltage of a corresponding odd-column subpixel after polarity inversion only reaches preset voltage intensity after a certain period of time, resulting in the same turn-on time between the current odd-column subpixel and the adjacent even-column subpixel. The current odd-column subpixel and the adjacent even-column subpixel share one data line and are enabled by the same gate enabling signal. C1 is the turn-on time of a first row of the gate enabling signal, C2 is the turn-on time of a second row of the gate enabling signal, and at this point, C1=C2; in this way, the final charging states of the two pixels are different. Referring to FIG. 5, a voltage of the even-column subpixels is greater than that of the odd-column subpixels, where Vp_even is a subpixel voltage corresponding to even columns, and Vp_odd is a subpixel voltage corresponding to odd columns; as a result, the even-column subpixels are brighter than the odd-column subpixels, so there are bright and dark lines in a vertical direction.

Referring to FIGS. 6 to 9, an embodiment of this application discloses a display panel 101, including a substrate 104, and the substrate 104 is provided with a plurality of data lines 120, a plurality of gate lines 110, and a plurality of pixel units 130; and a gate driver chip 102, where each pixel unit 130 includes subpixels of different colors; the gate driver chip 102 outputs gate enabling signals to the gate lines 110 to turn on the pixel units 130; each row of pixel units 130 includes a plurality of pixel groups, each pixel group includes a first column of subpixels 131 in the front and an adjacent following second column of subpixels 132, the first column of subpixels 131 and the second column of subpixels 132 are connected with the same data line 120, and the first column of subpixels 131 and the second column of subpixels 132 are connected to two different gate lines 110; the polarities of data driving signals adopted by two adjacent pixel groups in each row of pixel units are opposite; and a voltage of a gate enabling signal of the first column of subpixels 131 is greater than that of a gate enabling signal corresponding to the second column of subpixels 132.

In a half-source driver, when a gate voltage across adjacent even-column subpixels is equal to a gate signal of odd-column subpixels, due to the difference in actual charging time between the adjacent even-column subpixels and the odd-column subpixels caused by positive and negative polarity inversion of the data lines, the charging voltages of the pixels are different, so there are bright and dark lines in a vertical direction. In this scheme, by enabling the voltage of the gate enabling signal corresponding to the first column of subpixels 131 to be greater than that of the gate enabling signal corresponding to the second column of subpixels 132, a corresponding gate can be turned on faster due to the enhancement of the voltage of the gate enabling signal corresponding to the first column of subpixels 131, so that the first column of subpixels 131 can reach a higher charging voltage faster, the difference in charging voltage between two pixels before and after polarity inversion is reduced or even eliminated, and the charging voltages of two adjacent pixels tend to be the same, thus solving the problem of visual bright and dark lines in the vertical direction; in addition, the scheme does not require a design change, only needs to output gate enabling signals with different voltages every other row, and is convenient to operate.

The subpixels of different colors can be arranged along the direction of the gate lines or the data lines.

In one or more embodiments, the polarities of data driving voltages corresponding to the first column of subpixels 131 and the second column of subpixels 132 are the same, the first column of subpixels 131 are odd-column subpixels, the second column of subpixels 132 are even-column subpixels, and the voltage of the first gate enabling signal corresponding to the odd-column subpixels is greater than that of the second gate enabling signal of the even-column subpixels.

When the positive and negative polarities of a data line 120 are inverted, the data driving voltage of the corresponding odd-column subpixel after polarity inversion only reaches preset voltage intensity after a certain period of time, so that the same turn-on time between the odd-column subpixel and the corresponding even-column subpixel, and the odd-column subpixel and the corresponding even-column subpixel are enabled by the same gate enabling signal. And in this way, the final charging states of the two subpixels are different, resulting in bright and dark lines; and the charging of the pixels is the result of overlapping use of data signals and gate signals, signal delay will be caused under the condition of data signal polarity conversion, and for pixels without signal polarity conversion, data line signal delay will not occur. Therefore, a data line signal with data signal polarity conversion is low, and a data signal without data signal polarity conversion is high. In order to make the charging capacities of the data line signal with data signal polarity conversion and the data line signal with data signal polarity conversion equal, a pixel with a high data line signal (i.e. without polarity conversion) should have a low gate line signal, while a pixel with a low data line signal (i.e. with polarity conversion) should have a high gate line signal, so as to realize a balance and finally achieve equal charging and brightness. According to the scheme, two gate enabling signals (high and low respectively) are adopted, the high gate enabling signal correspondingly drives the odd-column subpixels, the low gate enabling signal correspondingly drives the even-column subpixels, so that odd-column gate scanning signals correspond to data line signals with polarity conversion, even-column gate signals correspond to data line signals without polarity conversion, the odd-column subpixels correspond to high data signals and the low gate enabling signal, and the even-column subpixels correspond to low data line signals and the high gate enabling signal; the high ones and the low ones are mutually complementary, so as to realize a balance and finally achieve equal charging, thus reducing the charging state difference between the the high ones and the low ones, avoiding the phenomenon of bright and dark lines and realizing equal brightness; in addition, if the gate enabling signal of the odd-column subpixels is adjusted to be higher than an original gate enabling signal and the gate enabling signal of the even-column subpixels is adjusted to be lower than the original gate enabling signal, the charging states of the the odd-column subpixels and the even-column subpixels can be adjusted to be consistent to avoid the occurrence of bright and dark lines.

Figure 7:
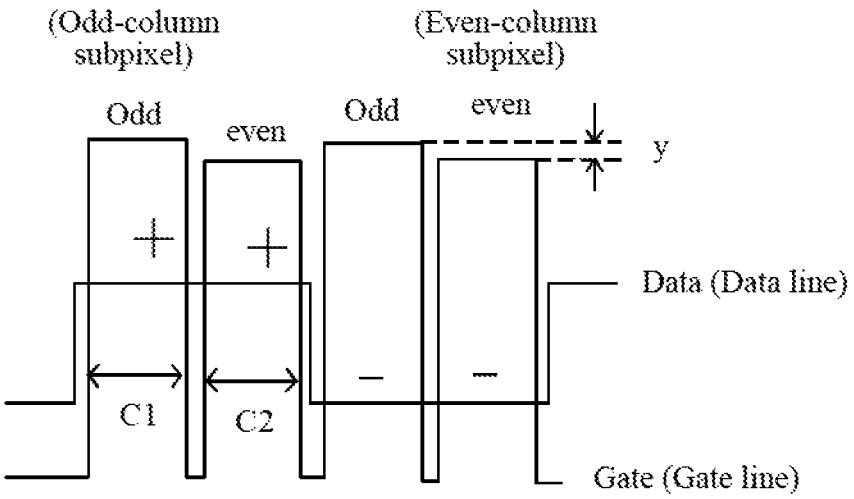
FIG. 7 is a schematic diagram of a data line output waveform of the display panel according to an embodiment of this application.
Figure 8:
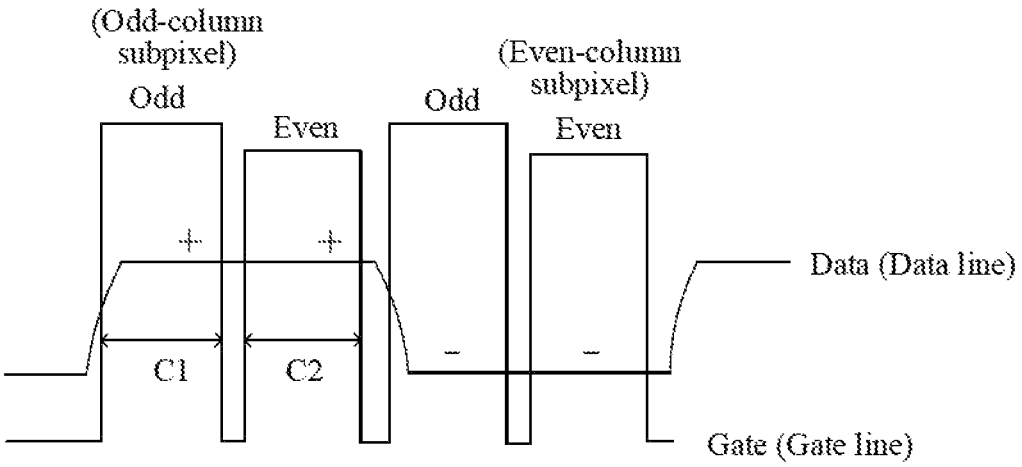
FIG. 8 is a schematic diagram of an actual data line output waveform of the display panel according to an embodiment of this application.
Figure 9:
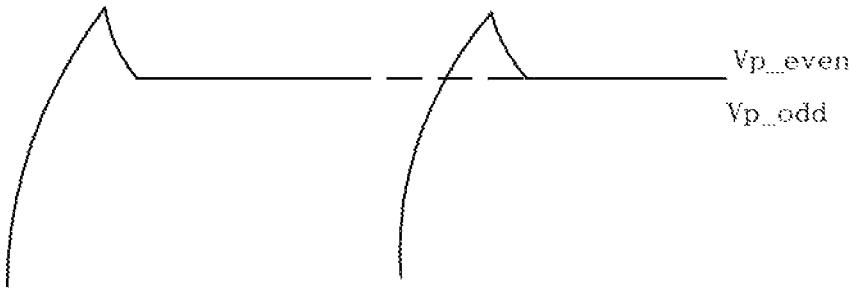
FIG. 9 is a schematic diagram of a pixel voltage of the display panel according to an embodiment of this application.

Referring to FIG. 7, in one or more embodiments, a difference between the voltage of the first gate enabling signal corresponding to the odd-column subpixels and the voltage of the second gate enabling signal corresponding to the even-column subpixels is y, and y is greater than 0 and less than or equal to 10 v. If the voltage difference between the gate enabling signals is too small, there is no way to solve the problem of bright and dark lines in the vertical direction; and if the voltage difference of charging is too large, the brightness may cause the original dark lines to be brighter than the original bright lines, so there will still be bright and dark lines, with positions reversed.

Figure 10:
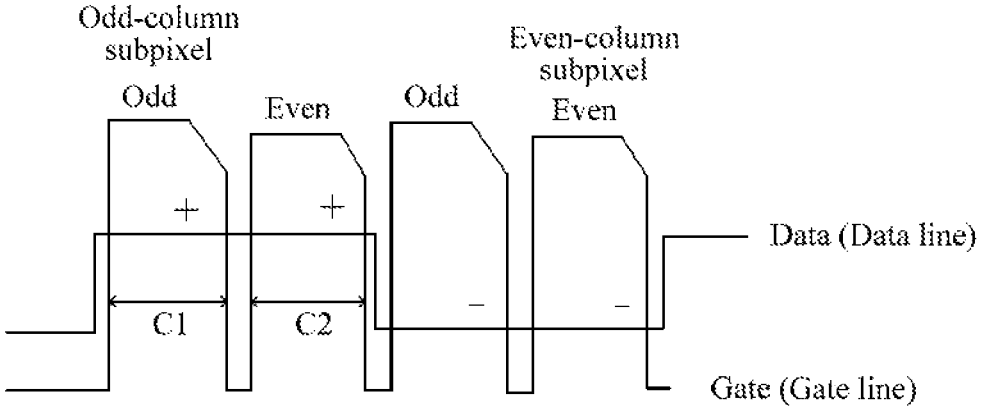
FIG. 10 is a schematic diagram of a chamfered data line output waveform of the display panel according to an embodiment of this application.
Figure 11:
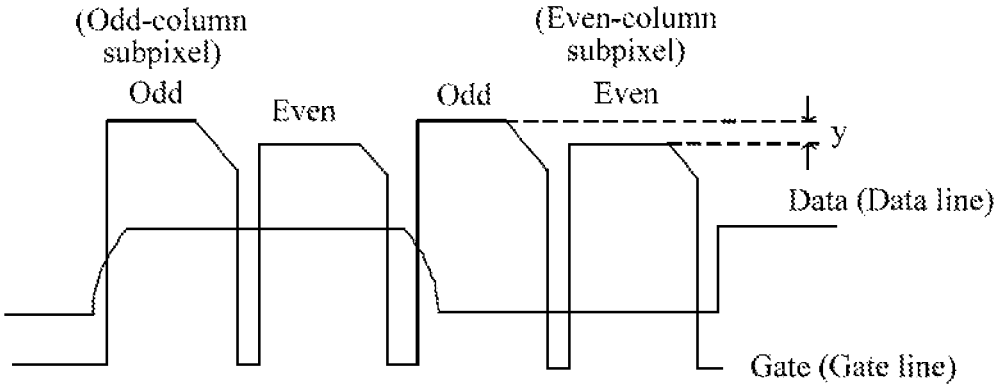
FIG. 11 is a schematic diagram of an actual chamfered data line output waveform of the display panel according to an embodiment of this application.

Referring to FIG. 10 and FIG. 11, in one or more embodiments, a waveform of the voltage of the first gate enabling signal and a waveform of the voltage of the second gate enabling signal are both chamfered waveforms. The waveforms of the gate enabling signals are both chamfered waveforms, that is, with chamfers, and the chamfer is located at the end of each waveform cycle. The chamfered waveforms enable a circuit to be more stable and the adjustment flexibility of a scanning waveform higher, so that the influences of RC delay on a chamfer of the scanning waveform with a slope as consistent as possible, RC delay is caused by the resistance and capacitance of the panel itself at different positions, the uniformity of the panel is good, and a good picture display effect is achieved.

In one or more embodiments, a slope of the chamfer of the first gate enabling signal is greater than that of the chamfer of the second gate enabling signal.

In terms of the display panel, dual driving is adopted for a large-size display panel, and the gate enabling signals enter from two sides. Due to the existence of RC delay, the charging effect of entry ends on the two sides is more favorable than that of a middle section, so that the charging brightness of the entry ends on the two sides is higher, and the brightness of the middle section is lower, thus making the two sides appear white. In this scheme, the gate is chamfered. Due to the existence of chamfers, the charging effect of the entry ends on the two sides is slightly weakened, so that the brightness difference between the middle section and the two sides is reduced, thus reducing the influence of whitening on the two sides of the display panel. Enabling the slope of the chamfer of the first gate enabling signal to be greater than that of the chamfer of the second gate enabling signal is one of the optional schemes to realize this effect.

In one or more embodiments, the first gate enabling signal includes a first pre-chamfer interval and a first chamfer interval in each cycle; the second gate enabling signal includes a second pre-chamfer interval and a second chamfer interval in each cycle; a voltage of the first pre-chamfer interval is greater than that of the second pre-chamfer interval; and a lowest voltage of the first chamfer interval is equal to a voltage of the second chamfer interval. Chamfering starts basically at the same time, and the voltages are equal after chamfering, so a slope of the first chamfer interval is larger than that of the second chamfer interval. The voltage of the first gate enabling signal of the odd-column subpixels before chamfering is greater than the voltage of the second gate enabling signal of the even-column subpixels before chamfering, and the voltage of the first gate enabling signal of the odd-column subpixels after chamfering is equal to the voltage of the second gate enabling signal of the even-column subpixels after chamfering.

In this scheme, before chamfering, the voltage of the first gate enabling signal of the odd-column subpixels is greater than the voltage of the second gate enabling signal of the even-column subpixels, and after chamfering, the voltage of the first gate enabling signal of the odd-column subpixels is equal to the voltage of the second gate enabling signal of the even-column subpixels. Therefore, an absolute value of a difference between a turning-on voltage VGH and a tuning-off voltage VGL of the odd-column subpixels is greater than an absolute value of a difference between the turning-on voltage VGH and the turning-off voltage VGL in even columns; and since the magnitude of flicker is related to the magnitude of the absolute value of (VGH-VGL), flicker can be reduced by reducing VGH, in this way, process margin and uniformity can be improved.

As another embodiment of this application, referring to FIGS. 6 to 11, a display panel 101 is disclosed, including a substrate 104, and the substrate 104 is provided with a plurality of data lines 120, a plurality of gate lines 110, and a plurality of pixel units 130; and a gate driver chip 102, where each pixel unit 130 includes subpixels of different colors arranged along the direction of the gate lines 110; the gate driver chip 102 outputs gate enabling signals to the gate lines 110 to turn on the pixel units 130; each row of pixel units includes a plurality of pixel groups, and each pixel group includes a first column of subpixels 131 in the front and an adjacent following second column of subpixels 132, the first column of subpixels 131 the second column of subpixels 132 are connected with the same data line 120, and the first column of subpixels 131 and the second column of subpixels 132 are connected to two different gate lines 110; the polarities of data driving signals adopted by two adjacent pixel groups in each row of pixel units are opposite; the polarities of data driving voltages corresponding to the first column of subpixels 131 and the second column of subpixels 132 are the same, the first column of subpixels 131 are odd-column subpixels, the second column of subpixels 132 are even-column subpixels, and a voltage of a first gate enabling signal corresponding to the odd-column subpixels is greater than that of a second gate enabling signal of the even-column subpixels; a difference between the voltage of the first gate enabling signal corresponding to the odd-column subpixels and the voltage of the second gate enabling signal corresponding to the even-column subpixels is y, and y is greater than 0 and less than or equal to 10 v; a waveform of the voltage of the first gate enabling signal and a waveform of the voltage of the second gate enabling signal are both chamfered waveforms; the first gate enabling signal includes a first pre-chamfer interval and a first chamfer interval in each cycle; the second gate enabling signal includes a second pre-chamfer interval and a second chamfer interval in each cycle; a voltage of the first pre-chamfer interval is greater than that of the second pre-chamfer interval; and a lowest voltage of the first chamfer interval is equal to a voltage of the second chamfer interval.

In a half-source driver, when a gate voltage across adjacent even-column subpixels is equal to a gate signal of odd-column subpixels, due to the difference in actual charging time between the adjacent even-column subpixels and the odd-column subpixels caused by positive and negative polarity inversion of the data lines 120, the charging voltages of the pixels are different, so there are bright and dark lines in a vertical direction. In this scheme, by enabling the voltage of the gate enabling signal corresponding to the first column of suhpixels 131 to be greater than that of the gate enabling signal corresponding to the second column of subpixels 132, a corresponding gate can be turned on faster due to the enhancement of the voltage of the gate enabling signal corresponding to the first column of subpixels 131, so that the first column of subpixels 131 can reach a higher charging voltage faster, the difference in charging voltage between two pixels before and after polarity inversion is reduced or even eliminated, and the charging voltages of two adjacent pixels tend to be the same, thus solving the problem of visual bright and dark lines in the vertical direction; in addition, the scheme does not require a design change, only needs to output gate enabling signals with different voltages every other row, and is convenient to operate.

Figure 12:
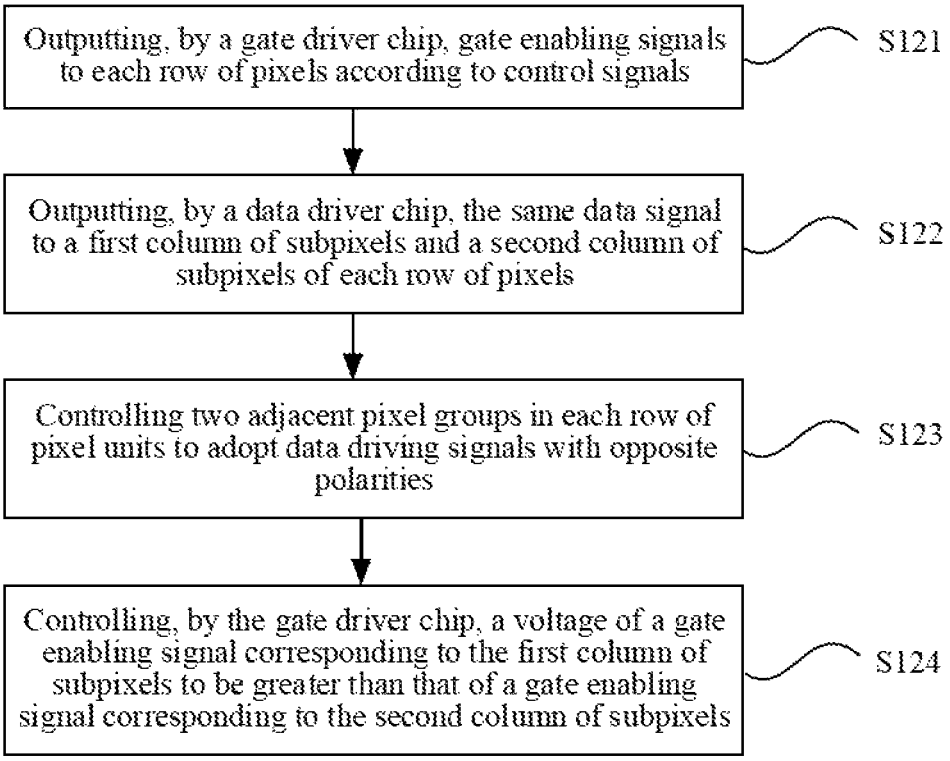
FIG. 12 is a schematic flowchart of a driving method of the display panel according to an embodiment of this application.

As another embodiment of this application, referring to FIG. 12, a driving method of a display panel is disclosed, including the steps of:

S121: outputting, by a gate driver chip, gate enabling signals to each row of pixel units according to control signals;

S122: outputting, by a data driver chip, the same data signal to a first column of subpixels and a second column of subpixels of each row of pixels;

S123: controlling two adjacent pixel groups in each row of pixel units to adopt data driving signals with opposite polarities; and S124: controlling, by the gate driver chip, a voltage of a gate enabling signal corresponding to the first column of subpixels to be greater than that of a gate enabling signal corresponding to the second column of subpixels.

The driving method of the display panel is applicable to the above-mentioned display panel. When a gate voltage across the adjacent even-column subpixels is equal to a gate signal of the odd-column subpixels, due to the difference in actual charging time between the even-column subpixels and the odd-column subpixels caused by the positive and negative polarity inversion of the data lines 120, the charging voltages of the pixels are different, so there are bright and dark lines in the vertical direction. In this scheme, by enabling the voltage of the gate enabling signal corresponding to the first column of subpixels 131 to be greater than that of the gate enabling signal corresponding to the second column of subpixels 132, a corresponding gate can be turned on faster due to the enhancement of the voltage of the gate enabling signal corresponding to the first column of subpixels 131, so that the first column of subpixels 131 can reach a preset charging voltage faster, the charging difference before and after polarity inversion is reduced or even eliminated, and the charging voltages of two adjacent pixels are the same, thus solving the problem of visual bright and dark lines in the vertical direction; in addition, the scheme does not require a design change, only needs to output gate enabling signals with different voltages every other row, and is convenient to operate.

In one or more embodiments, the polarities of data driving voltages corresponding to the first column of subpixels 131 and the second column of subpixels 132 are the same, the first column of subpixels 131 are odd-column subpixels, the second column of subpixels 132 are even-column subpixels, and the voltage of the first gate enabling signal corresponding to the odd-column subpixels is greater than that of the second gate enabling signal of the even-column subpixels.

When the positive and negative polarities of a data line 120 are inverted, the data driving voltage of the corresponding odd-column subpixel after polarity inversion only reaches preset voltage intensity after a certain period of time, so that the same turn-on time between the odd-column subpixel and the corresponding even-column subpixel, when the odd-column subpixel and the corresponding even-column subpixel are enabled by the same gate enabling signal. And in this way, the final charging states of the two pixels are different, resulting in bright and dark lines. According to the scheme, two gate enabling signals (high and low respectively) are adopted, the high gate enabling signal correspondingly drives the odd-column subpixels, so that thin film transistors of the odd-column subpixels are turned on faster, and the actual charging time of the odd-column subpixels is slightly longer than the charging time of the even-column subpixels, thus reducing the charging state difference between the odd-column subpixel and the corresponding even-column subpixel, and avoiding the phenomenon of bright and dark lines; in addition, if the gate enabling signal of the odd-column subpixels is adjusted to be higher than an original gate enabling signal and the gate enabling signal of the even-column subpixels is adjusted to be lower than the original gate enabling signal, the charging states of the the odd-column subpixel and the corresponding even-column subpixel can be adjusted to be consistent to avoid the occurrence of bright and dark lines.

In one or more embodiments, a difference between the voltage of the first gate enabling signal corresponding to the odd-column subpixels and the voltage of the second gate enabling signal corresponding to the even-column subpixels is y, and y is greater than 0 and less than or equal to 10 v.

In one or more embodiments, a waveform of the voltage of the first gate enabling signal and a waveform of the voltage of the second gate enabling signal are both chamfered waveforms; the first gate enabling signal includes a first pre-chamfer interval and a first chamfer interval in each cycle; the second gate enabling signal includes a second pre-chamfer interval and a second chamfer interval in each cycle; a voltage of the first pre-chamfer interval is greater than that of the second pre-chamfer interval; and a lowest voltage of the first chamfer interval is equal to a voltage of the second chamfer interval.

In this scheme, before chamfering, the voltage of the first gate enabling signal of the odd-column subpixels is greater than the voltage of the second gate enabling signal of the even-column subpixels, and after chamfering, the voltage of the first gate enabling signal of the odd-column subpixels is equal to the voltage of the second gate enabling signal of the even-column subpixels. Therefore, an absolute value of a difference between a turning-on voltage VGH and a turning-off voltage VGL of the odd-column subpixels is greater than an absolute value of a difference between the turning-on voltage VGH and the turning-off voltage VGL in even columns; and since the magnitude of flicker is related to the magnitude of the absolute value of (VGH-VGL), flicker can be reduced by reducing VGH voltage; in this way, process margin and uniformity can be improved.

Figure 13:
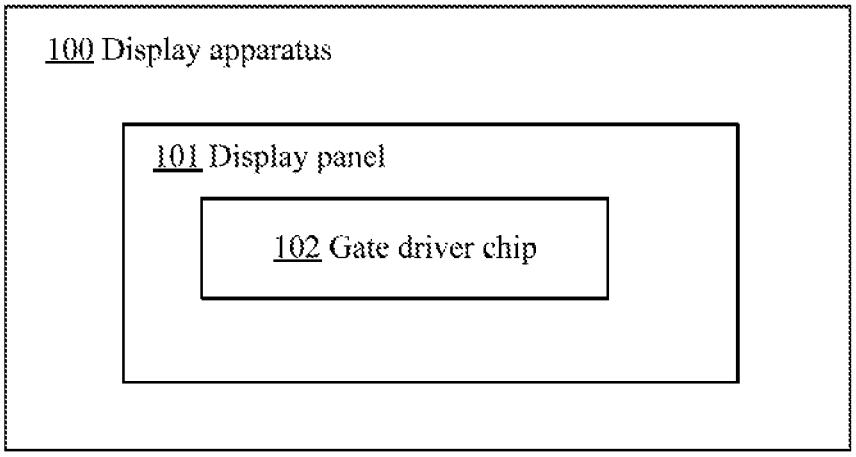
FIG. 13 is a schematic block diagram of a display apparatus according to an embodiment of this application.

As another embodiment of this application, with reference to FIG. 13, a display apparatus 100 is disclosed, including the foregoing display panel 101.

In a half-source driver, when a gate voltage across adjacent even-column subpixels is equal to a gate signal of odd-column subpixels, due to the difference in actual charging time between the adjacent odd-colunm subpixels and even-column subpixels caused by the positive and negative polarity inversion of the data lines 120, the charging voltages of the pixels are different, so there are bright and dark lines in a vertical direction. In this scheme, by enabling the voltage of the gate enabling signal corresponding to the first column of suhpixels 131 to be greater than that of the gate enabling signal corresponding to the second column of subpixels 132, a corresponding gate can be turned on faster due to the enhancement of the voltage of the gate enabling signal corresponding to the first column of subpixels 131, so that the first column of subpixels 131 can reach a higher charging voltage faster, the difference in charging voltage between two pixels before and after polarity inversion is reduced or even eliminated, and the charging voltages of two adjacent pixels tend to be the same, thus solving the problem of visual bright and dark lines in the vertical direction; in addition, the scheme does not require a design change, only needs to output gate enabling signals with different voltages every other row, and is convenient to operate.

It should be noted that the limitation of each step involved in this scheme is not deemed to limit the sequence of the steps on the premise of not affecting the implementation of the specific scheme. The steps written in front can be executed first, later or even at the same time. As long as this scheme can be implemented, it should be regarded as falling within the protection scope of this application.

The panel in this application may be a twisted nematic (TN) panel, an in-plane switching (IPS) panel, or a multi-domain vertical alignment (VA) panel, and may certainly be any other suitable type of panel.

The foregoing content describes the present application in detail with reference to the specific implementation manners, and it should not be regarded that the specific implementations of the present application are limited to these descriptions. Persons of ordinary skill in the art can further make simple deductions or replacements without departing from the concept of this application, and such deductions or replacements should all be considered as falling within the protection scope of this application.

What is claimed is:

1. A display panel, comprising:

a substrate;

the substrate being provided with:

a plurality of data lines, a plurality of gate lines, and a plurality of pixel units, and a gate driver chip configured to output gate enabling signals to the gate lines to turn on the pixel units, wherein each pixel unit comprises subpixels of different colors arranged along a direction of the gate lines;

each row of pixel units comprises a plurality of pixel groups, and each pixel group comprises a first-column subpixel in front and an adjacent subsequent second-column subpixel, the first-column subpixel and the second-column subpixel being connected with a same data line, and the first-column subpixel and the second-column subpixel being connected to two different gate lines;

the polarities of data driving signals adopted by two adjacent pixel groups in the each row of pixel units are opposite; and a voltage of a gate enabling signal of the first-column subpixel is greater than that of a gate enabling signal corresponding to the second-column subpixel;

each first-column subpixel is an odd-column subpixel, each second-column subpixel is an even-column subpixel, the first-column subpixel being connected to an odd-row gate line the second-column subpixel being connected to an even-row gate line;

and a voltage of a first gate enabling signal corresponding to the odd-column subpixel is greater than that of a second gate enabling signal of the even-column subpixel;

wherein a waveform of the voltage of the first gate enabling signal and a waveform of the voltage of the second gate enabling signal are both chamfered waveforms;

wherein each cycle of the first gate enabling signal comprises a first pre-chamfer interval and a first chamfer interval;

each cycle of the second gate enabling signal comprises a second pre-chamfer interval and a second chamfer interval;

wherein a time interval separating a starting point of the first chamfer interval from a starting point of the first gate enabling signal is equal to a time interval separating a starting point of the second chamfer interval from a starting point of the second gate enabling signal;

wherein a slope of the first chamfer interval is greater than that of the second chamfer interval;

a magnitude of the voltage of the first gate enabling signal of the odd-column subpixel after chamfering is equal to a magnitude of the voltage of the second gate enabling signal of the even-column subpixel after chamfering.

2. The display panel according to claim 1, wherein the charging voltages of the first-column subpixel and the second-column subpixel are identical.

3. The display panel according to claim 1, wherein the polarities of data driving voltages corresponding to the first-column subpixel and the second-column subpixel are identical.

4. The display panel according to claim 3, wherein a difference between the voltage of the first gate enabling signal corresponding to the odd-column subpixel and the voltage of the second gate enabling signal corresponding to the even-column subpixel is y, and y is greater than 0 and less than or equal to 10 v.

5. The display panel according to claim 1, wherein a voltage of the first pre-chamfer interval is greater than that of the second pre-chamfer interval; and a lowest voltage of the first chamfer interval is equal to a lowest voltage of the second chamfer interval.

6. The display panel according to claim 1, wherein the display panel adopts a half-source driver.

7. The display panel according to claim 1, wherein the display panel adopts a dual driving mode.

8. The display panel according to claim 1, wherein a duration of the first pre-chamfer interval is equal to a duration of the second pre-chamfer interval.

9. The display panel according to claim 1, wherein an absolute value of a difference between a turning-on voltage and a turning-off voltage of the odd-column subpixel is greater than an absolute value of a difference between the turning-on voltage and the turning-off voltage of the even-column subpixel.

10. A driving method of a display panel, comprising:

outputting, by a gate driver chip, gate enabling signals to each row of pixel units according to control signals;

outputting, by a data driver chip, a same data signal to a first-column subpixel and a second-column subpixel of each row of pixels;

controlling two adjacent pixel groups in each row of pixels to adopt data driving signals with opposite polarities; and controlling, by the gate driver chip, a voltage of a gate enabling signal corresponding to the first-column subpixel to be greater than that of a gate enabling signal corresponding to the second-column subpixel;

wherein each first-column subpixel is an odd-column subpixel, each second-column subpixel is an even-column subpixel, the first-column subpixel being connected to an odd-row gate line, second-column subpixel being connected to an even-row gate line;

and a voltage of a first gate enabling signal corresponding to the odd-column subpixel is greater than that of a second gate enabling signal of the even-column subpixel;

wherein a waveform of the voltage of the first gate enabling signal and a waveform of the voltage of the second gate enabling signal are both chamfered waveforms;

wherein each cycle of the first gate enabling signal comprises a first pre-chamfer interval and a first chamfer interval;

each cycle of the second gate enabling signal comprises a second pre-chamfer interval and a second chamfer interval;

wherein a time interval separating a starting point of the first chamfer interval from a starting point of the first gate enabling signal is equal to a time interval separating a starting point of the second chamfer interval from a starting point of the second gate enabling signal;

wherein a slope of the first chamfer interval is greater than that of the second chamfer interval;

a magnitude of the voltage of the first gate enabling signal of the odd-column subpixel after chamfering is equal to a magnitude of the voltage of the second gate enabling signal of the even-column subpixel after chamfering.

11. The driving method of the display panel according to claim 10, wherein the polarities of data driving voltages corresponding to the first-column subpixel and the second-column subpixel are identical.

12. The driving method of the display panel according to claim 11, wherein a difference between the voltage of the first gate enabling signal corresponding to the odd-column subpixel and the voltage of the second gate enabling signal corresponding to the even-column subpixel is y, and y is greater than 0 and less than or equal to 10 v.

13. The driving method of the display panel according to claim 11, wherein;

a voltage of the first pre-chamfer interval is greater than that of the second pre-chamfer interval; and a lowest voltage of the first chamfer interval is equal to a lowest voltage of the second chamfer interval.

14. The driving method of the display panel according to claim 10, wherein the charging voltages of the first-column subpixel and the second-column subpixel are identical.

15. A display apparatus, comprising a display panel, wherein the display panel comprises:

a substrate, the substrate being provided with a plurality of data lines, a plurality of gate lines, and a plurality of pixel units, and each pixel unit comprising subpixels of different colors arranged along a direction of the gate lines;

and a gate driver chip configured to output gate enabling signals to the gate lines to turn on the pixel units;

each row of pixel units comprises a plurality of pixel groups, and each pixel group comprises a first-column subpixel in front and an adjacent subsequent second-column subpixel, the first-column subpixel and the second-column subpixel being connected with a same data line, and the first-column subpixel and the second-column subpixel being connected to two different gate lines;

the polarities of data driving signals adopted by two adjacent pixel groups in the each row of pixel units are opposite; and a voltage of a gate enabling signal of the first-column subpixel is greater than that of a gate enabling signal corresponding to the second-column subpixel;

wherein each first-column subpixel is an odd-column subpixel, each second-column subpixel is an even-column subpixel, the first-column subpixel being connected to an odd-row gate line, and the second-column subpixel being connected to an even-row gate line;

and a voltage of a first gate enabling signal corresponding to the odd-column subpixel is greater than that of a second gate enabling signal of the even-column subpixel;

wherein a waveform of the voltage of the first gate enabling signal and a waveform of the voltage of the second gate enabling signal are both chamfered waveforms;

wherein each cycle of the first gate enabling signal comprises a first pre-chamfer interval and a first chamfer interval;

each cycle of the second gate enabling signal comprises a second pre-chamfer interval and a second chamfer interval;

wherein a time interval separating a starting point of the first chamfer interval from a starting; point of the first gate enabling signal is equal to a time interval separating a starting point of the second chamfer interval from a starting point of the second gate enabling signal;

wherein a slope of the first chamfer interval is greater than that of the second chamfer interval;

a magnitude of the voltage of the first gate enabling signal of the odd-column subpixel after chamfering is equal to a magnitude of the voltage of the second gate enabling signal of the even-column subpixel after chamfering.

16. The display apparatus according to claim 15, wherein the display apparatus is one of a twisted nematic display apparatus, an in-plane switching display apparatus, and a multi-domain vertical alignment display apparatus.

* * * * *